US010140931B2

(12) United States Patent
Li

(10) Patent No.: US 10,140,931 B2
(45) Date of Patent: Nov. 27, 2018

(54) SHADOW MASK ASSEMBLIES AND REUSING METHODS OF SHADOW MASK ASSEMBLIES THEREOF

(71) Applicant: Shenzhen China Star Optoelectronics Technology Co., Ltd., Shenzhen, Guangdong (CN)

(72) Inventor: Wendong Li, Guangdong (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 26 days.

(21) Appl. No.: 15/526,288

(22) PCT Filed: Feb. 13, 2017

(86) PCT No.: PCT/CN2017/073421
§ 371 (c)(1),
(2) Date: May 11, 2017

(87) PCT Pub. No.: WO2018/133136
PCT Pub. Date: Jul. 26, 2018

(65) Prior Publication Data

US 2018/0293946 A1 Oct. 11, 2018

(51) Int. Cl.
*G09G 3/34* (2006.01)
*G09G 3/00* (2006.01)

(52) U.S. Cl.
CPC ..... *G09G 3/3406* (2013.01); *G09G 3/003* (2013.01); *G09G 2320/0633* (2013.01); *G09G 2320/0646* (2013.01); *G09G 2330/021* (2013.01)

(58) Field of Classification Search
None
See application file for complete search history.

(56) References Cited

U.S. PATENT DOCUMENTS 8,902,297 B2 * 12/2014 Park ..... G09G 3/003 348/51
2011/0157167 A1 * 6/2011 Bennett ..... G06F 3/14 345/419
2011/0273480 A1 * 11/2011 Park ..... G02B 27/2264 345/690
2013/0293795 A1 * 11/2013 Murao ..... G02B 27/2264 349/15
2015/0334791 A1 * 11/2015 Cao ..... G09G 3/34 315/192

(Continued)

*Primary Examiner* — Kenneth B Lee, Jr.
(74) *Attorney, Agent, or Firm* — Andrew C. Cheng

(57) ABSTRACT

The present disclosure discloses a backlight control circuit for adjusting a current of an LED module of an electronic device including a driving chip having a feedback terminal and a reference voltage terminal, a feedback voltage regulating unit, and a power supply regulating unit; the feedback voltage regulating unit is also connected to the 2D/3D signal terminal, the feedback terminal voltage is controlled so that the feedback terminal voltage of the feedback terminal of the driving chip is lower than the reference voltage of the reference voltage terminal when receiving the three-dimensional signal generated at the 2D/3D signal terminal. The present application also provides an electronic device. With the scheme of the present application, the current of the LED module can be increased when the electronic device is in the three-dimensional mode.

20 Claims, 2 Drawing Sheets

(56) References Cited

U.S. PATENT DOCUMENTS

2016/0140912 A1* 5/2016 Im ..... G09G 3/003
345/690
2016/0284282 A1* 9/2016 Zhang ..... H05B 33/0827

* cited by examiner

SHADOW MASK ASSEMBLIES AND REUSING METHODS OF SHADOW MASK ASSEMBLIES THEREOF

CROSS REFERENCE

The present disclosure claims the priority of No. 201710039158.3, entitled "backlight control circuit and electronic device", filed on Jan. 19, 2017, the disclosure of which is incorporated herein by reference in its entirety.

FIELD OF THE DISCLOSURE

The present disclosure relates to a control circuit, and more particularly to a backlight control circuit and an electronic device.

BACKGROUND OF THE DISCLOSURE

The current use of LED (light-emitting diode) as a backlight of electronic devices more and more. Current electronic devices such as televisions, computer displays, etc. can often work in 2D mode or 3D mode. At present, in the three-dimensional mode, the current flowing through the LED needs to be higher than the two-dimensional mode to provide sufficient backlight brightness in three-dimensional mode. Therefore, when the electronic device is operated in three-dimensional mode, it is necessary to increase the current of the LED, and when the electronic device is operated in the two-dimensional mode, it is necessary to reduce the current of the LED. However, the existing implementation in the three-dimensional mode to improve the LED current circuit structure is more complex.

SUMMARY OF THE DISCLOSURE

The present disclosure provides a backlight control circuit and an electronic device capable of improving a current flowing through an LED module as a backlight in a three-dimensional mode by a simple structure.

A backlight control circuit for adjusting the current of an LED module of an electronic device, the LED module includes a positive terminal, a ground terminal, and at least one LED lamp and a detection resistor connected between the positive terminal and the ground terminal, wherein, the backlight control circuit includes: a driving chip including a feedback terminal, a reference voltage terminal and an output terminal, the reference voltage terminal is connected with a reference voltage; a feedback voltage regulating unit connected between the feedback terminal of the driving chip and a remote terminal of the detection resistor for adjusting the detection voltage of the remote terminal of the detection resistor to the feedback terminal voltage of the feedback terminal; a power supply regulating unit connected between the power supply circuit of the electronic device and the positive terminal of the LED module and connected with the output terminal of the driving chip for adjusting the power supply circuit to output to a supply voltage of the LED module in response to the control of the driving chip; wherein the feedback voltage adjustment unit is also connected to a 2D/3D signal terminal for receiving a two-dimensional signal or a three-dimensional signal generated by the 2D/3D signal terminal, wherein the 2D/3D signal terminal generates a two-dimensional signal when the electronic device is in the two-dimensional mode and generates a three-dimensional signal when the electronic device is in the three-dimensional mode; when the three-dimensional signal is received, the feedback voltage regulating unit controls the lowering of the feedback voltage of the detection voltage to the feedback terminal so that the feedback terminal voltage is smaller than the reference voltage, the driving chip controls the power supply adjusting unit to increase the supply voltage to the LED module when the feedback terminal voltage is less than the reference voltage to increase the current flowing through the LED lamp of the LED module.

Wherein, when the two-dimensional signal is received, the feedback voltage adjusting unit controls the detection voltage of the remote terminal of the detection resistor to be transferred to the feedback terminal voltage of the feedback terminal, such that the feedback terminal voltage is greater than the reference voltage, wherein the driving chip controls the power supply adjusting unit to lower the supply voltage to the LED module when the feedback terminal voltage is greater than the reference voltage to reduce the current flowing through the LED lamp of the LED module.

Wherein, the feedback voltage regulating unit includes a first resistor, a second resistor and a first switch tube, the first resistor, the second resistor and the first switch tube are connected in series between the remote terminal of the detection resistor and the ground, the feedback terminal of the driving chip is connected with the connection node of the first resistor and the second resistor, the gate of the first switch tube is connected with the 2D/3D signal terminal, the source is grounded, the drain is connected with the second resistor.

wherein, when the first switch tube receives the two-dimensional signal generated at the 2D/3D signal terminal, the first switch tune is turned off, the branch of the first resistor and second resistor is turned off, the feedback terminal voltage is equal to the detection voltage of the detection, the driving chip compares the feedback terminal voltage with the reference voltage, and controlling the power supply regulating unit to adjust the supply voltage applied to the LED module when the feedback terminal voltage is not equal to the reference voltage, until the feedback terminal voltage is equal to the reference voltage, controlling the power supply adjustment unit to maintain a current supply voltage to the LED module, so that the current of the LED lamp and the detection resistor flowing through the LED module is maintained at $I_L$=Vref/Rf, wherein, Vref is the reference voltage, and Rf is the resistance value of the detection resistor.

Wherein, when the first switch tube receives the three-dimensional signal generated at the 2D/3D signal terminal, the first switch tune is turned on, the branch of the first resistor and second resistor is turned on, At this time the feedback terminal voltage V1=Vf*R2/(R1+R2), wherein, V1 is the feedback terminal voltage, Vf is the detection voltage of the remote terminal of the detection resistor, R1 is the resistance value of the first resistor, R2 is the resistance value of the second resistor, when the driving chip in the feedback terminal voltage and the reference voltage is not equal, controlling the power supply adjustment unit to adjust the supply voltage output to the LED module, until the feedback terminal voltage is equal to the reference voltage, controlling the power supply adjustment unit to maintain a current supply voltage to the LED module, so that the current of the LED lamp and the detection resistor flowing through the LED module is maintained at $I_L$=Vf/Rf=(R1+R2)*Vref/(R2*Rf), wherein, Vref is the reference voltage, Rf is the resistance value of the detection resistor.

Wherein, the three-dimensional signal is a high level signal, the two-dimensional signal is a low level signal, the first switch tube is a high level on-switch, the first switch tube is turned on when the gate receives the high level three-dimensional signal, and is turned off when the gate receives the low level two-dimensional signal.

Wherein, the driving chip includes a comparator and a PWM signal generator, the positive input terminal of the comparator is connected with the reference voltage terminal, the reverse input terminal is connected with the feedback terminal, the output terminal of the comparator is connected with the negative electrode of the PWM signal generator, the positive electrode of the PWM signal generator is connected with a positive voltage, the output terminal of the PWM signal generator serves as the output terminal of the driving chip.

Wherein, the power supply regulating unit includes a second switch tube, the gate of the second switch tube is connected with the output terminal of the PWM signal generator, the source is grounded, the drain is coupled to the output terminal of the power supply circuit and the positive terminal of the LED module, the PWM signal generator is used for outputting the PWM signal to control the periodic turn-on and turn-off of the second switch tube, and adjusting the voltage outputted from the power supply circuit.

Wherein, the second switch tube is a high-level on-switch; the comparator outputting the low level signal when the feedback terminal voltage is less than the reference voltage, the PWM signal generator controls the lowering of the duty ratio of the outputted PWM signal when the low level signal is received at the negative input terminal so that the on-time of the second switch tube becomes shorter in one cycle, thereby increasing the duty ratio of the power supply voltage outputted to the LED module by the power supply circuit and increasing the supply voltage to the LED module; the comparator outputs a high level signal when the feedback terminal voltage is greater than the reference voltage, the PWM signal generator controls to increase the duty ratio of the outputted PWM signal when the high level signal is received at the negative input terminal so that the on-time of the switch tube becomes longer in one cycle, thereby reducing the duty ratio of the power supply voltage outputted to the LED module by the power supply circuit, and reducing the supply voltage to the LED module.

Wherein, the first switch tube and the second switch tube are NMOS transistors or NPN transistors.

An electronic device includes a power supply circuit, a LED module and a backlight control circuit, the power supply circuit is used to output the power supply voltage, the LED module includes a positive terminal, a ground terminal, and at least one LED lamp and a detection resistor connected between the positive terminal and the ground terminal. The backlight control circuit includes: a driving chip including a feedback terminal, a reference voltage terminal and an output terminal, the reference voltage terminal is connected with a reference voltage; a feedback voltage regulating unit connected between the feedback terminal of the driving chip and a remote terminal of the detection resistor for adjusting the detection voltage of the remote terminal of the detection resistor to the feedback terminal voltage of the feedback terminal; a power supply regulating unit connected between the power supply circuit of the electronic device and the positive terminal of the LED module and connected with the output terminal of the driving chip for adjusting the power supply circuit to output to a supply voltage of the LED module in response to the control of the driving chip; wherein the feedback voltage adjustment unit is also connected to a 2D/3D signal terminal for receiving a two-dimensional signal or a three-dimensional signal generated by the 2D/3D signal terminal, wherein the 2D/3D signal terminal generates a two-dimensional signal when the electronic device is in the two-dimensional mode and generates a three-dimensional signal when the electronic device is in the three-dimensional mode; when the three-dimensional signal is received, the feedback voltage regulating unit controls the lowering of the feedback voltage of the detection voltage to the feedback terminal so that the feedback terminal voltage is smaller than the reference voltage, the driving chip controls the power supply adjusting unit to increase the supply voltage to the LED module when the feedback terminal voltage is less than the reference voltage to increase the current flowing through the LED lamp of the LED module.

Wherein, when the two-dimensional signal is received, the feedback voltage adjusting unit controls the detection voltage of the remote terminal of the detection resistor to be transferred to the feedback terminal voltage of the feedback terminal, such that the feedback terminal voltage is greater than the reference voltage, wherein the driving chip controls the power supply adjusting unit to lower the supply voltage to the LED module when the feedback terminal voltage is greater than the reference voltage to reduce the current flowing through the LED lamp of the LED module.

Wherein, the feedback voltage regulating unit includes a first resistor, a second resistor and a first switch tube, the first resistor, the second resistor and the first switch tube are connected in series between the remote terminal of the detection resistor and the ground, the feedback terminal of the driving chip is connected with the connection node of the first resistor and the second resistor, the gate of the first switch tube is connected with the 2D/3D signal terminal, the source is grounded, the drain is connected with the second resistor.

Wherein, when the first switch tube receives the two-dimensional signal generated at the 2D/3D signal terminal, the first switch tune is turned off, the branch of the first resistor and second resistor is turned off, the feedback terminal voltage is equal to the detection voltage of the detection, the driving chip compares the feedback terminal voltage with the reference voltage, and controlling the power supply regulating unit to adjust the supply voltage applied to the LED module when the feedback terminal voltage is not equal to the reference voltage, until the feedback terminal voltage is equal to the reference voltage, controlling the power supply adjustment unit to maintain a current supply voltage to the LED module, so that the current of the LED lamp and the detection resistor flowing through the LED module is maintained at $I_L$=Vref/Rf, wherein, Vref is the reference voltage, and Rf is the resistance value of the detection resistor.

Wherein, when the first switch tube receives the three-dimensional signal generated at the 2D/3D signal terminal, the first switch tune is turned on, the branch of the first resistor and second resistor is turned on, At this time the feedback terminal voltage V1=Vf*R2/(R1+R2), wherein, V1 is the feedback terminal voltage, Vf is the detection voltage of the remote terminal of the detection resistor, R1 is the resistance value of the first resistor, R2 is the resistance value of the second resistor, when the driving chip in the feedback terminal voltage and the reference voltage is not equal, controlling the power supply adjustment unit to adjust the supply voltage output to the LED module, until the feedback terminal voltage is equal to the reference voltage, controlling the power supply adjustment unit to maintain a current supply voltage to the LED module, so that the current of the LED lamp and the detection resistor flowing through the LED module is maintained at $I_L$=Vf/Rf=(R1+R2)*Vref/(R2*Rf), wherein, Vref is the reference voltage, Rf is the resistance value of the detection resistor.

Wherein, the three-dimensional signal is a high level signal, the two-dimensional signal is a low level signal, the first switch tube is a high level on-switch, the first switch tube is turned on when the gate receives the high level three-dimensional signal, and is turned off when the gate receives the low level two-dimensional signal.

Wherein, the driving chip includes a comparator and a PWM signal generator, the positive input terminal of the comparator is connected with the reference voltage terminal, the reverse input terminal is connected with the feedback terminal, the output terminal of the comparator is connected with the negative electrode of the PWM signal generator, the positive electrode of the PWM signal generator is connected with a positive voltage, the output terminal of the PWM signal generator serves as the output terminal of the driving chip.

Wherein, the power supply regulating unit includes a second switch tube, the gate of the second switch tube is connected with the output terminal of the PWM signal generator, the source is grounded, the drain is coupled to the output terminal of the power supply circuit and the positive terminal of the LED module, the PWM signal generator is used for outputting the PWM signal to control the periodic turn-on and turn-off of the second switch tube, and adjusting the voltage outputted from the power supply circuit.

Wherein, the second switch tube is a high-level on-switch; the comparator outputting the low level signal when the feedback terminal voltage is less than the reference voltage, the PWM signal generator controls the lowering of the duty ratio of the outputted PWM signal when the low level signal is received at the negative input terminal so that the on-time of the second switch tube becomes shorter in one cycle, thereby increasing the duty ratio of the power supply voltage outputted to the LED module by the power supply circuit and increasing the supply voltage to the LED module; the comparator outputs a high level signal when the feedback terminal voltage is greater than the reference voltage, the PWM signal generator controls to increase the duty ratio of the outputted PWM signal when the high level signal is received at the negative input terminal so that the on-time of the switch tube becomes longer in one cycle, thereby reducing the duty ratio of the power supply voltage outputted to the LED module by the power supply circuit, and reducing the supply voltage to the LED module.

Wherein, the first switch tube and the second switch tube are NMOS transistors or NPN transistors.

In the electronic device and the backlight control circuit of the present disclosure, when the electronic device enters the three-dimensional mode, the feedback voltage adjustment unit controls to reduce the feedback terminal voltage transmitted to the feedback terminal of the driving chip, so that the feedback terminal voltage of the feedback terminal of the driver chip is smaller than the reference voltage of the reference voltage terminal of the driving chip, the driving chip controls the power supply voltage of the LED module to increase the current flowing through the LED module to meet the requirement of the three-dimensional mode when comparing the voltage of the feedback terminal is less than the reference voltage; the backlight control circuit uses a simple structure to achieve in the electronic device is in three-dimensional mode, to enhance the flow through the LED module.

BRIEF DESCRIPTION OF THE DRAWINGS

In order to more clearly illustrate the embodiments or the prior art technical solutions embodiment of the present disclosure, it will implement the following figures for the cases described in the prior art or require the use of a simple introduction, Obviously, in the following description The drawings are only some embodiments of the present disclosure, those of ordinary skill in terms of creative effort without precondition, you can also obtain other drawings based on these drawings.

DETAILED DESCRIPTION OF PREFERRED EMBODIMENTS

The present disclosure will now be combined with the implementation of the drawings, were a clear example of the technical solutions of the present disclosure, a complete description of, obviously, the described embodiments are only part of the embodiments of the present disclosure, but not all embodiments example. Based on the embodiments of the present disclosure, those of ordinary skill in making all other embodiments no creative effort obtained are within the scope of protection of the present disclosure.

Figure 1:
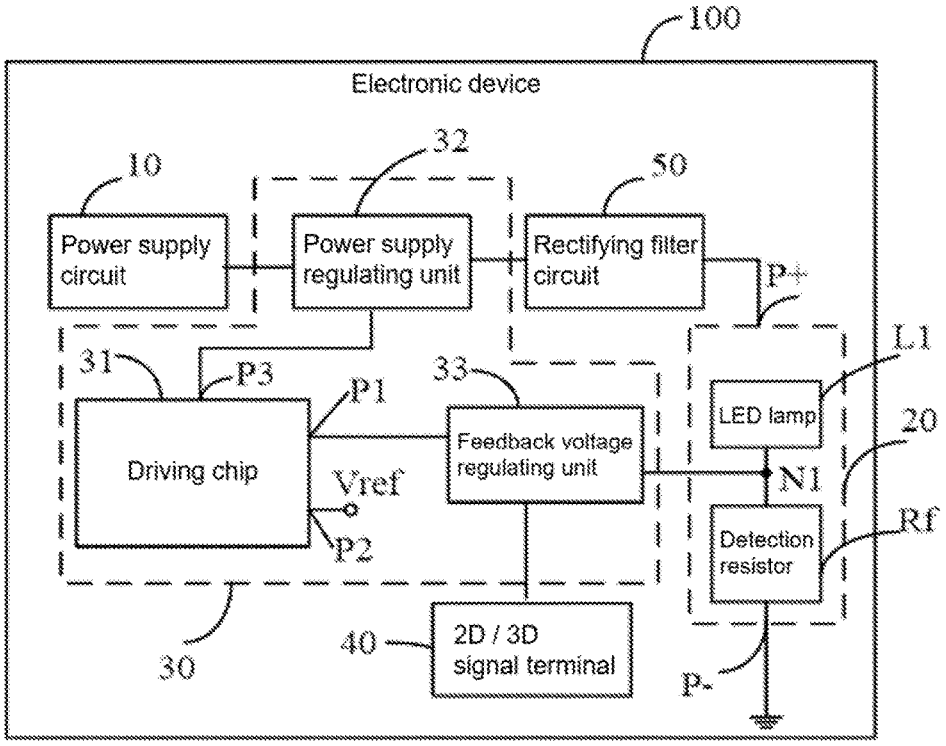
FIG. 1 is a block diagram of an electronic device having a backlight control circuit.

Please refer to FIG. 1, FIG. 1 is a block diagram of the electronic device of the present disclosure 100 (hereinafter referred to as the electronic device 100). The electronic device 100 includes a power supply circuit 10, a LED (light-emitting diode) module 20, a backlight module 30 and a 2D/3D signal terminal 40. The backlight control circuit 30 is used to adjust the current of the LED module 20 of the electronic device 100.

The LED module 20 includes a positive terminal P+, a ground terminal P− and at least one LED lamp L1 and one detection resistor Rf connected in series between the positive terminal P+ and the ground terminal P−.

The backlight control circuit 30 includes a driving chip 31, a power supply regulating unit 32 and a feedback voltage regulating unit 33. The driving chip 31 includes a feedback terminal P1, a reference voltage terminal P2 and an output terminal P3. The feedback voltage regulating unit 33 is connected between the feedback terminal P1 and the remote terminal N1 of the detection resistor Rf. The feedback voltage regulating unit 33 is used to adjust the detection voltage Vf of the remote terminal N1 of the detection resistor Rf to the feedback terminal voltage V1 of the feedback terminal P1. The reference voltage terminal R2 is used to access a reference voltage Vref. Wherein, the reference voltage Vref may be a voltage value, such as 5 volts, which is fixed to the electronic device 100 after power is applied.

The power supply regulating unit 32 is coupled between the power supply circuit 10 and the positive terminal P1 of the LED module 20, at the same time, the power supply regulating unit 32 is also connected with the driving chip 31 for adjusting the supply voltage of the power supply circuit 10 to the LED module 20 in response to the control of the driving chip 31.

The driving chip 31 compares the feedback terminal voltage V1 of the feedback terminal P1 with the reference voltage Vref of the reference voltage terminal P2, the driving chip 31 is used to control the power supply regulating unit 32 to increase the supply voltage to the LED module 20 when the feedback terminal voltage V1 is smaller than the reference voltage Vref, and the control power supply adjusting unit 32 lowers the supply voltage to the LED module 20 until the feedback terminal voltage V1 is equal to the reference voltage Vref when the feedback terminal voltage V1 is greater than the reference voltage Vref.

The 2D/3D signal terminal 40 is used to generate a corresponding two-dimensional signal or a three-dimensional signal when the electronic device 100 is operating in a two-dimensional mode or a three-dimensional mode. That is, the 2D/3D signal terminal 40 generates a two-dimensional signal when the electronic device 100 operates in a two-dimensional mode and generates a three-dimensional signal when the electronic device 100 operates in a three-dimensional mode. Wherein the 2D/3D signal terminal 40 may be a pin of a processing unit (not shown), the processing unit outputs the corresponding two-dimensional signal or the three-dimensional signal through the 2D/3D signal terminal 40 according to the current operating mode of the electronic device 100.

The feedback voltage regulating unit 33 is connected with the 2D/3D signal terminal 40 for controlling the decrease of the detection voltage Vf of the remote terminal N1 of the detection resistor Rf to the feedback terminal voltage V1 of the feedback terminal P1 when the three-dimensional signal is received, such that the feedback terminal voltage V1 is smaller than the reference voltage Vref. Thus, the driving chip 31 controls the power supply regulating unit 32 to increase the supply voltage to the LED module 20 when the feedback terminal voltage V1 is smaller than the reference voltage Vref to increase the current flowing through the LED module 20, i.e. the current flowing through the LED lamp L1 and the feedback resistor Rf of the LED module 20 is increased. As a result, the supply voltage of the LED module 20 is increased, and accordingly, the current flowing through the LED module 20 is also increased to satisfy the need for a larger current when the electronic device 100 is operated in the three-dimensional mode.

Wherein the feedback voltage regulating unit 33 controls the detection voltage Vf of the remote terminal N1 of the detection resistor Rf to the feedback terminal voltage V1 of the feedback terminal P1 when the two-dimensional signal is received so that the feedback terminal voltage V1 is greater than the reference voltage Vref. Thus, the driving chip 31 controls the power supply regulating unit 32 to lower the supply voltage to the LED module 20 when the feedback terminal voltage V1 is greater than the reference voltage Vref to reduce the current flowing through the LED lamp, the current flowing through the LED lamp L1 and the feedback resistor Rf of the LED module 20 is reduced. Since the supply voltage of the LED module 20 is reduced, correspondingly, the current flowing through the LED module 20 is also reduced, thus, to meet the two-dimensional mode LED lamp only need a lower current demand, it is avoided that the LED module 20 is continuously supplied with a large current to conserve power.

As shown in FIG. 1, the electronic device 100 further includes a rectifying filter circuit 50, the rectifying filter circuit 50 is coupled between the power supply regulating unit 32 and the positive terminal P+ of the LED module 20, for rectifying and filtering the supply voltage adjusted by the power supply regulating unit 32.

Figure 2:
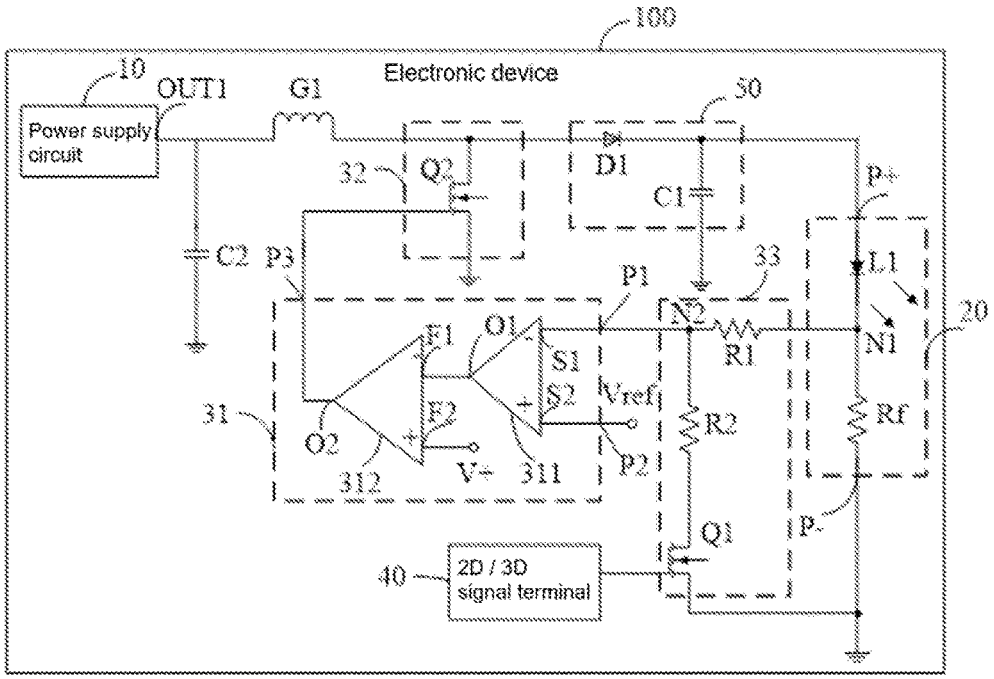
FIG. 2 is a specific circuit diagram of the electronic device having the backlight control circuit shown in FIG. 1.

Please refer to FIG. 2, FIG. 2 is a specific circuit diagram of the electronic device 100 in the preferred embodiment of the present disclosure. As shown in FIG. 2, the feedback voltage regulating unit 33 includes a first resistor R1, a second resistor R2, and a first switch tube Q1. The first resistor R1, the second resistor R2 and the first switch tube Q1 are connected in series between the remote terminal N1 and the ground of the detection resistor Rf. The feedback terminal P1 of the driving chip 31 is connected to the connection node N2 of the first resistor R1 and the second resistor R2.

The gate of the first switch tube Q1 is connected to the 2D/3D signal terminal 40, the source is grounded and the drain is connected to the second resistor R2. Wherein, the first switch tube Q1 is turned off when a two-dimensional signal generated by the 2D/3D signal terminal 40 is received and turned on when a three-dimensional signal generated by the 2D/3D signal terminal 40 is received.

When the first switch tube Q1 receives the two-dimensional signal generated by the 2D/3D signal terminal 40, the branch of the first resistor R1 and the second resistor R2 is turned off due to the first switch tube Q1 being turned off. The detection voltage Vf of the detection resistor Rf is equal to the feedback terminal voltage V1. That is, the feedback voltage regulating unit 33 adjusts the detection voltage Vf of the remote terminal N1 of the detection resistor Rf to the feedback terminal voltage V1 of the feedback terminal P1 to be equal to the detection voltage Vf.

As described above, the driving chip 31 compares the feedback terminal voltage V1 with the reference voltage Vref and controls the power supply regulating unit 32 to adjust the supply voltage applied to the LED module 20 when comparing the feedback terminal voltage V1 with the reference voltage Vref is not equal, until the feedback terminal voltage V1 is equal to the reference voltage Vref. The change in the supply voltage of the LED module 20 causes the detection voltage Vf on the detection resistor Rf to change, that is, the feedback terminal voltage V1 may be changed, when the feedback terminal voltage V1 is equal to the reference voltage Vref, the equilibrium state is reached at this time, the driving chip 31 controls the power supply regulating unit 32 to maintain the supply voltage currently output to the LED module 20. At this time, since the feedback terminal voltage V1 is equal to the reference voltage Vref and the detection voltage Vf, the current IL flowing through the LED lamp L1 and the detection resistor Rf of the LED module 20 is maintained at $I_L$=Vref/Rf.

When the first switch tube Q1 receives the three-dimensional signal generated by the 2D/3D signal terminal 40, since the first switch tube Q1 is turned on at this time, the branch of the first resistor R1 and the second resistor R2 are turned on. Assuming that the resistance values of the first resistor R1 and the second resistor R2 are R1 and R2, respectively, the feedback terminal voltage V1=Vf*R2/(R1+R2) is smaller than the detection voltage Vf. That is, the feedback voltage regulating unit 33 adjusts the detection voltage Vf of the remote terminal N1 of the detection resistor Rf to the feedback terminal voltage V1 of the feedback terminal P1 to be equal to the Vf*R2/(R1+R2).

Since the detection voltage Vf is equal to the reference voltage Vref before the first switch tube Q1 receives the three-dimensional signal, thus, at the time when the first switch tube Q1 receives the three-dimensional signal on, the feedback terminal voltage V1 will be smaller than the reference voltage Vref. As described above, the drive chip 31 controls the power supply regulating unit 32 to increase the supply voltage to the LED module 20 when comparing the feedback terminal voltage V1 smaller than the reference voltage Vref, thus, the current flowing through the LED lamp L1 and the detection resistor Rf rises, and the detection voltage Vf also rises. Since the feedback terminal voltage V1=Vf*R2/(R1+R2) is proportional to the detected voltage Vf, the feedback terminal voltage V1 also rises.

The driving chip 31 controls the power supply regulating unit 32 to maintain the supply voltage currently output to the LED module 20 when the feedback terminal voltage V1 rises above the reference voltage Vref. Thus, the detection voltage Vf=(R1+R2)*V1/R2=(R1+R2)*Vref/R2. the current $I_L$=Vf/Rf=(R1+R2)*Vref/(R2*Rf) flowing through the LED module 20 will be greater than the current Vref/Rf flowing through the LED module 20 in the two-dimensional mode.

Accordingly, the driving chip 31 controls the power supply regulating unit 32 to adjust the power supply voltage outputted to the LED module 20 when comparing the feedback terminal voltage V1 with the reference voltage Vref, the power supply regulating unit 32 controls the power supply voltage to be output to the LED module 20 until the feedback terminal voltage V1 is equal to the reference voltage Vref, So that the current flowing through the LED lamp L1 and the detection resistor Rf flowing through the LED module 20 is maintained at $I_L$=Vf/Rf=(R1+R2)*Vref/(R2*Rf).

Obviously, when the electronic device 100 is switched from the three-dimensional mode to the two-dimensional mode, the first switch tube Q1 receives the two-dimensional signal generated by the 2D/3D signal terminal 40 and turns off, at this time, the feedback terminal voltage V1 will be directly equal to the detection voltage Vf. And the detection voltage Vf is the voltage (R1+R2)*Vref/R2 in the three-dimensional mode, which is larger than the reference voltage Vref at the time of switching. Thus, as previously described, the drive chip 31 will control the power supply adjustment unit 32 to lower the supply voltage to the LED module 20 until the feedback voltage V1 falls below the reference voltage Vref. At this time, since the feedback terminal voltage V1 is equal to the reference voltage Vref and the detection voltage, the current flowing through the LED lamp L1 of the LED module 20 and the current IL of the detection resistor Rf is maintained at the current $I_L$=Vref/Rf in the two-dimensional mode.

In the present application, when the electronic device 100 is in the two-dimensional mode or the three-dimensional mode, the detection voltage Vf of the remote terminal N1 of the detection resistor Rf to the feedback terminal voltage of the feedback terminal P1 is adjusted by the feedback voltage regulating unit 33, the current flowing through the LED module 20 may be reduced in the two-dimensional mode or the current flowing through the LED module 20 may be increased in the three-dimensional mode.

The resistance relationship of the resistors R1 and R2 can be set according to the needs of the electronic device 100. For example, when the current flowing through the LED module 20 in the three-dimensional mode needs to be twice that of the two-dimensional mode, the values of the resistors R1 and the resistors R2 may be equal to, for example, 100 ohms.

In some embodiments, the three-dimensional signal is a high level signal, the two-dimensional signal is a low level signal, the first switch tube Q1 is a high level on-switch, for example an NMOS transistor, the first switch tube Q1 is turned on when the gate receives a high-level three-dimensional signal, and is turned off when the gate receives a low-level two-dimensional signal.

As shown in FIG. 2, the driver chip 31 includes a comparator 311 and a PWM (Pulse Width Modulation) signal generator 312. The inverting input terminal S1 of the comparator 311 is connected to the feedback terminal P1, and the non-inverting input terminal S2 is connected to the reference voltage terminal P2. The output terminal O1 of the comparator 311 is connected to the negative input terminal F1 of the PWM signal generator 312, and the positive input terminal F2 of the PWM signal generator 312 is connected to a positive voltage V+. The positive voltage V+ is also fixed to the voltage supplied by the electronic device 100, for example, 3 volts or the like.

As shown in FIG. 2, the power supply regulating unit 32 includes a second switch tube Q2. The gate of the second switch tube Q2 is connected with the output terminal O2 of the PWM signal generator 312, the source is grounded and the drain is coupled with the output terminal OUT1 of the power supply circuit 10 and the positive terminal P+ of the LED module 20. The output terminal O2 of the PWM signal generator 312 serves as the output terminal P3 of the driving chip 31. The PWM signal generator 312 controls the second switch tube Q2 to be turned on and off periodically by outputting a PWM signal through the output terminal O2 to adjust the voltage outputted from the power supply circuit 10.

When the first switch tube Q1 receives the two-dimensional signal generated by the 2D/3D signal terminal 40 and is turned off, there is no current flowing in the first resistor R1 due to the virtual shortness of the comparator 311, at this time, the feedback terminal voltage V1 of the feedback terminal P1 is equal to the detection voltage Vf of the connection node N1.

When the first switch tube Q1 receives the three-dimensional signal generated by the 2D/3D signal terminal 40 and turns on, the branches of the first resistor R1 and the second resistor R2 are turned on, at this time, the feedback terminal voltage V1=Vf*R2/(R1+R2) of the feedback terminal P1.

In the present embodiment, the second switch tube Q2 is a high-level on-switch, for example, an NMOS transistor. The comparator 311 compares the feedback terminal voltage V1 and the reference voltage Vref, and the comparator 311 outputs a low level signal when the feedback terminal voltage V1 is smaller than the reference voltage. When the PWM signal generator 312 receives the low level signal at the negative input terminal F1, the PWM signal generator 312 controls the duty ratio of the outputted PWM signal so as to shorten the on-time of the second switch tube Q2 in one cycle, thereby increasing the duty ratio of the power supply voltage of the power supply circuit 10 to the LED module 20, and increasing the supply voltage to the LED module 20.

The comparator 311 outputs a high-level signal when comparing the feedback terminal voltage V1 to the reference voltage. When the high-level input terminal F1 of the PWM signal generator 312 receives the high-level signal, it controls the duty ratio of the PWM signal outputted, so that the on-time of the second switch tube Q2 becomes longer in one cycle, thereby reducing the duty ratio of the power supply voltage of the power supply circuit 10 to the LED module 20 and reducing the supply voltage to the LED module 20.

Since the feedback terminal voltage V1 of the feedback terminal P1 is equal to the detection voltage Vf in the two-dimensional mode and equal to Vf*R2/(R1+R2) in the three-dimensional mode, therefore, the feedback terminal voltage V1 has a proportional relationship with the detection voltage Vf. When the supply voltage to the LED module 20 is increased, the detection voltage Vf also increases, and similarly, the feedback terminal voltage V1 increases. When the supply voltage to the LED module 20 is reduced, the detection voltage Vf also decreases, and similarly, the feedback terminal voltage V1 also decreases. Thus, when the comparator 311 compares the feedback terminal voltage V1 with less than the reference voltage Vref, the feedback terminal voltage V1 will be increased to be equal to the reference voltage Vref. When the comparator 311 compares the feedback terminal voltage V1 greater than the reference voltage, the feedback terminal voltage V1 will be reduced until it is equal to the reference voltage Vref.

Since the reference voltage Vref is a fixed value, the detection voltage Vf is equal to the feedback terminal voltage V1 equal to the reference voltage Vref when the electronic device 100 is stably operating in the two-dimensional mode, At this time, the current $I_L$=Vref/Rf flowing through the LED lamp L1 in the LED module 20. When the electronic device 100 is stable in the three-dimensional mode, the feedback terminal voltage V1 is equal to the reference voltage Vref and the feedback terminal voltage V1=Vref=Vf*R2/(R1+R2). At this time, the detection voltage (R1+R2)*Vref/R2 of the detection resistor Rf, the current flowing through the LED lamp L1 in the LED module 20 $I_L$=Vf/Rf=(R1+R2)*Vref/(R2*Rf)), which is greater than the current flowing by the LED lamp L1 in the two-dimensional mode.

As shown in FIG. 2, the rectifying filter circuit 50 includes a diode D1 and a first capacitor C1, the anode of the diode D1 is connected to the drain of the second switch tube Q2, and the negative terminal is connected to one end of the first capacitor C1 and the positive terminal P+ of the LED, and the other end of the first capacitor C1 is grounded.

As shown in FIG. 2, the power supply circuit 10 and the power supply regulating unit 32 further include a second capacitor C2 and an inductance G1, the second capacitor C2 and the inductance G1 are used for filtering the voltage outputted from the power supply circuit 10 and adjusting the voltage.

Here, the power supply circuit 10 may include a voltage conversion circuit or the like for accessing a voltage of the mains power supply or the battery and converting the access voltage into a power supply voltage suitable for the electronic device 100. The electronic device 100 may be a liquid crystal display, an electronic device such as a liquid crystal television, a computer or a mobile phone having a liquid crystal display.

The first switch tube Q1 and the second switch tube Q2 of the present disclosure may be replaced with an NPN transistor. Obviously, in other embodiments, the first switch tube Q1, the second switch tube Q2 may also be a PMOS tube or a PNP transistor.

The above-mentioned disclosure is merely a preferred embodiment of the present disclosure, and it is of course not possible to limit the scope of the present disclosure, it will be understood by those of ordinary skill in the art that all or part of the processes described above are carried out and that equivalents to the claims are still within the scope of the disclosure.

What is claimed is:

1. A backlight control circuit for adjusting the current of an LED module of an electronic device, the LED module comprises a positive terminal, a ground terminal, and at least one LED lamp and a detection resistor connected between the positive terminal and the ground terminal, wherein, the backlight control circuit comprises:

a driving chip comprising a feedback terminal, a reference voltage terminal and an output terminal, the reference voltage terminal is connected with a reference voltage;

a feedback voltage regulating unit connected between the feedback terminal of the driving chip and a remote terminal of the detection resistor for adjusting the detection voltage of the remote terminal of the detection resistor to the feedback terminal voltage of the feedback terminal; and a power supply regulating unit connected between the power supply circuit of the electronic device and the positive terminal of the LED module and connected with the output terminal of the driving chip for adjusting the power supply circuit to output to a supply voltage of the LED module in response to the control of the driving chip;

wherein the feedback voltage adjustment unit is also connected to a 2D/3D signal terminal for receiving a two-dimensional signal or a three-dimensional signal generated by the 2D/3D signal terminal, wherein the 2D/3D signal terminal generates a two-dimensional signal when the electronic device is in the two-dimensional mode and generates a three-dimensional signal when the electronic device is in the three-dimensional mode; when the three-dimensional signal is received, the feedback voltage regulating unit controls the lowering of the feedback voltage of the detection voltage to the feedback terminal so that the feedback terminal voltage is smaller than the reference voltage, the driving chip controls the power supply adjusting unit to increase the supply voltage to the LED module when the feedback terminal voltage is less than the reference voltage to increase the current flowing through the LED lamp of the LED module.

2. The backlight control circuit according to claim 1, wherein, when the two-dimensional signal is received, the feedback voltage adjusting unit controls the detection voltage of the remote terminal of the detection resistor to be transferred to the feedback terminal voltage of the feedback terminal, such that the feedback terminal voltage is greater than the reference voltage, wherein the driving chip controls the power supply adjusting unit to lower the supply voltage to the LED module when the feedback terminal voltage is greater than the reference voltage to reduce the current flowing through the LED lamp of the LED module.

3. The backlight control circuit according to claim 2, wherein, the feedback voltage regulating unit comprises a first resistor, a second resistor and a first switch tube, the first resistor, the second resistor and the first switch tube are connected in series between the remote terminal of the detection resistor and the ground, the feedback terminal of the driving chip is connected with the connection node of the first resistor and the second resistor, the gate of the first switch tube is connected with the 2D/3D signal terminal, the source is grounded, the drain is connected with the second resistor.

4. The backlight control circuit according to claim 3, wherein, when the first switch tube receives the two-dimensional signal generated at the 2D/3D signal terminal, the first switch tune is turned off, the branch of the first resistor and second resistor is turned off, the feedback terminal voltage is equal to the detection voltage of the detection, the driving chip compares the feedback terminal voltage with the reference voltage, and controlling the power supply regulating unit to adjust the supply voltage applied to the LED module when the feedback terminal voltage is not equal to the reference voltage, until the feedback terminal voltage is equal to the reference voltage, controlling the power supply adjustment unit to maintain a current supply voltage to the LED module, so that the current of the LED lamp flowing through the LED module is maintained at $I_L$=Vref/Rf, wherein, Vref is the reference voltage, and Rf is the resistance value of the detection resistor.

5. The backlight control circuit according to claim 4, wherein, when the first switch tube receives the three-dimensional signal generated at the 2D/3D signal terminal, the first switch tune is turned on, the branch of the first resistor and second resistor is turned on, At this time the feedback terminal voltage V1=Vf*R2/(R1+R2), wherein, V1 is the feedback terminal voltage, Vf is the detection voltage of the remote terminal of the detection resistor, R1 is the resistance value of the first resistor, R2 is the resistance value of the second resistor, when the driving chip in the feedback terminal voltage and the reference voltage is not equal, controlling the power supply adjustment unit to adjust the supply voltage output to the LED module, until the feedback terminal voltage is equal to the reference voltage, controlling the power supply adjustment unit to maintain a current supply voltage to the LED module, so that the current of the LED lamp flowing through the LED module is maintained at $I_L$=Vf/Rf=(R1+R2)*Vref/(R2*Rf), wherein, Vref is the reference voltage, Rf is the resistance value of the detection resistor.

6. The backlight control circuit according to claim 5, wherein, the three-dimensional signal is a high level signal, the two-dimensional signal is a low level signal, the first switch tube is a high level on-switch, the first switch tube is turned on when the gate receives the high level three-dimensional signal, and is turned off when the gate receives the low level two-dimensional signal.

7. The backlight control circuit according to claim 5, wherein, the driving chip comprises a comparator and a PWM signal generator, the positive input terminal of the comparator is connected with the reference voltage terminal, the reverse input terminal is connected with the feedback terminal, the output terminal of the comparator is connected with the negative electrode of the PWM signal generator, the positive electrode of the PWM signal generator is connected with a positive voltage, the output terminal of the PWM signal generator serves as the output terminal of the driving chip.

8. The backlight control circuit according to claim 7, wherein, the power supply regulating unit comprises a second switch tube, the gate of the second switch tube is connected with the output terminal of the PWM signal generator, the source is grounded, the drain is coupled to the output terminal of the power supply circuit and the positive terminal of the LED module, the PWM signal generator is used for outputting the PWM signal to control the periodic turn-on and turn-off of the second switch tube, and adjusting the voltage outputted from the power supply circuit.

9. The backlight control circuit according to claim 8, wherein, the second switch tube is a high-level on-switch; the comparator outputting the low level signal when the feedback terminal voltage is less than the reference voltage, the PWM signal generator controls the lowering of the duty ratio of the outputted PWM signal when the low level signal is received at the negative input terminal so that the on-time of the second switch tube becomes shorter in one cycle, thereby increasing the duty ratio of the power supply voltage outputted to the LED module by the power supply circuit and increasing the supply voltage to the LED module; the comparator outputs a high level signal when the feedback terminal voltage is greater than the reference voltage, the PWM signal generator controls to increase the duty ratio of the outputted PWM signal when the high level signal is received at the negative input terminal so that the on-time of the switch tube becomes longer in one cycle, thereby reducing the duty ratio of the power supply voltage outputted to the LED module by the power supply circuit, and reducing the supply voltage to the LED module.

10. The backlight control circuit according to claim 8, wherein, the first switch tube and the second switch tube are NMOS transistors or NPN transistors.

11. An electronic device comprises a power supply circuit and a LED module, the power supply circuit is used to output the power supply voltage, the LED module comprises a positive terminal, a ground terminal, and at least one LED lamp and a detection resistor connected between the positive terminal and the ground terminal, wherein, the electronic device further comprises a backlight control circuit, the backlight control circuit comprises:

a driving chip comprising a feedback terminal, a reference voltage terminal and an output terminal, the reference voltage terminal is connected with a reference voltage;

a feedback voltage regulating unit connected between the feedback terminal of the driving chip and a remote terminal of the detection resistor for adjusting the detection voltage of the remote terminal of the detection resistor to the feedback terminal voltage of the feedback terminal; and a power supply regulating unit connected between the power supply circuit of the electronic device and the positive terminal of the LED module and connected with the output terminal of the driving chip for adjusting the power supply circuit to output to a supply voltage of the LED module in response to the control of the driving chip;

wherein the feedback voltage adjustment unit is also connected to a 2D/3D signal terminal for receiving a two-dimensional signal or a three-dimensional signal generated by the 2D/3D signal terminal, wherein the 2D/3D signal terminal generates a two-dimensional signal when the electronic device is in the two-dimensional mode and generates a three-dimensional signal when the electronic device is in the three-dimensional mode; when the three-dimensional signal is received, the feedback voltage regulating unit controls the lowering of the feedback voltage of the detection voltage to the feedback terminal so that the feedback terminal voltage is smaller than the reference voltage, the driving chip controls the power supply adjusting unit to increase the supply voltage to the LED module when the feedback terminal voltage is less than the reference voltage to increase the current flowing through the LED lamp of the LED module.

12. The electronic device according to claim 11, wherein, when the two-dimensional signal is received, the feedback voltage adjusting unit controls the detection voltage of the remote terminal of the detection resistor to be transferred to the feedback terminal voltage of the feedback terminal, such that the feedback terminal voltage is greater than the reference voltage, wherein the driving chip controls the power supply adjusting unit to lower the supply voltage to the LED module when the feedback terminal voltage is greater than the reference voltage to reduce the current flowing through the LED lamp of the LED module.

13. The electronic device according to claim 12, wherein, the feedback voltage regulating unit comprises a first resistor, a second resistor and a first switch tube, the first resistor, the second resistor and the first switch tube are connected in series between the remote terminal of the detection resistor and the ground, the feedback terminal of the driving chip is connected with the connection node of the first resistor and the second resistor, the gate of the first switch tube is connected with the 2D/3D signal terminal, the source is grounded, the drain is connected with the second resistor.

14. The electronic device according to claim 13, wherein, when the first switch tube receives the two-dimensional signal generated at the 2D/3D signal terminal, the first switch tune is turned off, the branch of the first resistor and second resistor is turned off, the feedback terminal voltage is equal to the detection voltage of the detection, the driving chip compares the feedback terminal voltage with the reference voltage, and controlling the power supply regulating unit to adjust the supply voltage applied to the LED module when the feedback terminal voltage is not equal to the reference voltage, until the feedback terminal voltage is equal to the reference voltage, controlling the power supply adjustment unit to maintain a current supply voltage to the LED module, so that the current of the LED lamp flowing through the LED module is maintained at $I_L$=Vref/Rf, wherein, Vref is the reference voltage, and Rf is the resistance value of the detection resistor.

15. The electronic device according to claim 14, wherein, when the first switch tube receives the three-dimensional signal generated at the 2D/3D signal terminal, the first switch tune is turned on, the branch of the first resistor and second resistor is turned on, At this time the feedback terminal voltage V1=Vf*R2/(R1+R2), wherein, V1 is the feedback terminal voltage, Vf is the detection voltage of the remote terminal of the detection resistor, R1 is the resistance value of the first resistor, R2 is the resistance value of the second resistor, when the driving chip in the feedback terminal voltage and the reference voltage is not equal, controlling the power supply adjustment unit to adjust the supply voltage output to the LED module, until the feedback terminal voltage is equal to the reference voltage, controlling the power supply adjustment unit to maintain a current supply voltage to the LED module, so that the current of the LED lamp flowing through the LED module is maintained at $I_L$=Vf/Rf=(R1+R2)*Vref/(R2*Rf), wherein, Vref is the reference voltage, Rf is the resistance value of the detection resistor.

16. The electronic device according to claim 15, wherein, the three-dimensional signal is a high level signal, the two-dimensional signal is a low level signal, the first switch tube is a high level on-switch, the first switch tube is turned on when the gate receives the high level three-dimensional signal, and is turned off when the gate receives the low level two-dimensional signal.

17. The electronic device according to claim 15, wherein, the driving chip comprises a comparator and a PWM signal generator, the positive input terminal of the comparator is connected with the reference voltage terminal, the reverse input terminal is connected with the feedback terminal, the output terminal of the comparator is connected with the negative electrode of the PWM signal generator, the positive electrode of the PWM signal generator is connected with a positive voltage, the output terminal of the PWM signal generator serves as the output terminal of the driving chip.

18. The electronic device according to claim 17, wherein, the power supply regulating unit comprises a second switch tube, the gate of the second switch tube is connected with the output terminal of the PWM signal generator, the source is grounded, the drain is coupled to the output terminal of the power supply circuit and the positive terminal of the LED module, the PWM signal generator is used for outputting the PWM signal to control the periodic turn-on and turn-off of the second switch tube, and adjusting the voltage outputted from the power supply circuit.

19. The electronic device according to claim 18, wherein, the second switch tube is a high-level on-switch; the comparator outputting the low level signal when the feedback terminal voltage is less than the reference voltage, the PWM signal generator controls the lowering of the duty ratio of the outputted PWM signal when the low level signal is received at the negative input terminal so that the on-time of the second switch tube becomes shorter in one cycle, thereby increasing the duty ratio of the power supply voltage outputted to the LED module by the power supply circuit and increasing the supply voltage to the LED module; the comparator outputs a high level signal when the feedback terminal voltage is greater than the reference voltage, the PWM signal generator controls to increase the duty ratio of the outputted PWM signal when the high level signal is received at the negative input terminal so that the on-time of the switch tube becomes longer in one cycle, thereby reducing the duty ratio of the power supply voltage outputted to the LED module by the power supply circuit, and reducing the supply voltage to the LED module.

20. The electronic device according to claim 18, wherein, the first switch tube and the second switch tube are NMOS transistors or NPN transistors.

* * * * *